US008752829B1

(12) United States Patent
Uehling

(10) Patent No.: US 8,752,829 B1
(45) Date of Patent: Jun. 17, 2014

(54) ROTATABLE AND TRANSLATABLE MECHANICAL FLAG

(71) Applicant: Hewlett-Packard Development Company, L.P., Houston, TX (US)

(72) Inventor: Devin S. Uehling, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/743,590

(22) Filed: Jan. 17, 2013

(51) Int. Cl.
*B65H 7/02* (2006.01)

(52) U.S. Cl.
CPC ..... *B65H 7/02* (2013.01); *B65H 2553/41* (2013.01); *B65H 2553/61* (2013.01)
USPC ..... 271/258.01; 271/265.01

(58) Field of Classification Search
CPC ..... B65H 7/02; B65H 7/14; B65H 2553/41; B65H 2553/412; B65H 2553/61; B65H 2553/612
USPC ..... 271/258.01, 265.01, 25, 31, 38, 130
See application file for complete search history.

(56) References Cited

U.S. PATENT DOCUMENTS

| | | | | |
|---|---|---|---|---|
| 4,195,937 | A | 4/1980 | Baran | |
| 4,345,193 | A | 8/1982 | Barger et al. | |
| 6,247,695 | B1 * | 6/2001 | Linder et al. | 271/265.04 |
| 6,783,026 | B2 * | 8/2004 | Chambers et al. | 271/265.01 |
| 6,907,314 | B2 | 6/2005 | Reasoner et al. | |
| 7,182,336 | B2 * | 2/2007 | Fukushima et al. | 271/265.01 |
| 7,216,865 | B2 | 5/2007 | Tamura et al. | |
| 8,142,011 | B2 | 3/2012 | Kobayashi | |
| 2004/0135311 | A1 * | 7/2004 | Chambers et al. | 271/265.01 |
| 2005/0051949 | A1 * | 3/2005 | Carter et al. | 271/258.01 |
| 2005/0133992 | A1 * | 6/2005 | Ueng et al. | 271/902 |
| 2007/0075484 | A1 * | 4/2007 | Terada | 271/258.01 |
| 2007/0284812 | A1 * | 12/2007 | Hirai | 271/265.01 |
| 2008/0303204 | A1 * | 12/2008 | Lee et al. | 271/121 |
| 2012/0228819 | A1 * | 9/2012 | Chien-Kuo | 271/110 |

* cited by examiner

*Primary Examiner* — David H Bollinger

(57) ABSTRACT

A mechanical flag for an object detection device includes a body portion, a head portion extending from the body portion, a tail portion extending from the body portion; and an elongate aperture disposed in the body portion and about which the mechanical flag is rotatable and translatable.

18 Claims, 6 Drawing Sheets

ROTATABLE AND TRANSLATABLE MECHANICAL FLAG

BACKGROUND

Printers for transferring images to paper or other media may include sensors to detect the presence of a sheet of print media, often times being triggered by the approaching edge of the print media. Sometimes the sensor is activated by a mechanical flag that rotates around a fixed pivot axle. Because the motion of these flags is limited, the sensitivity of the sensor-flag pair is limited to certain directions of media movement.

BRIEF DESCRIPTION OF THE DRAWINGS

For a detailed description of various examples, reference will now be made to the accompanying drawings in which.

NOTATION AND NOMENCLATURE

Figure 1:
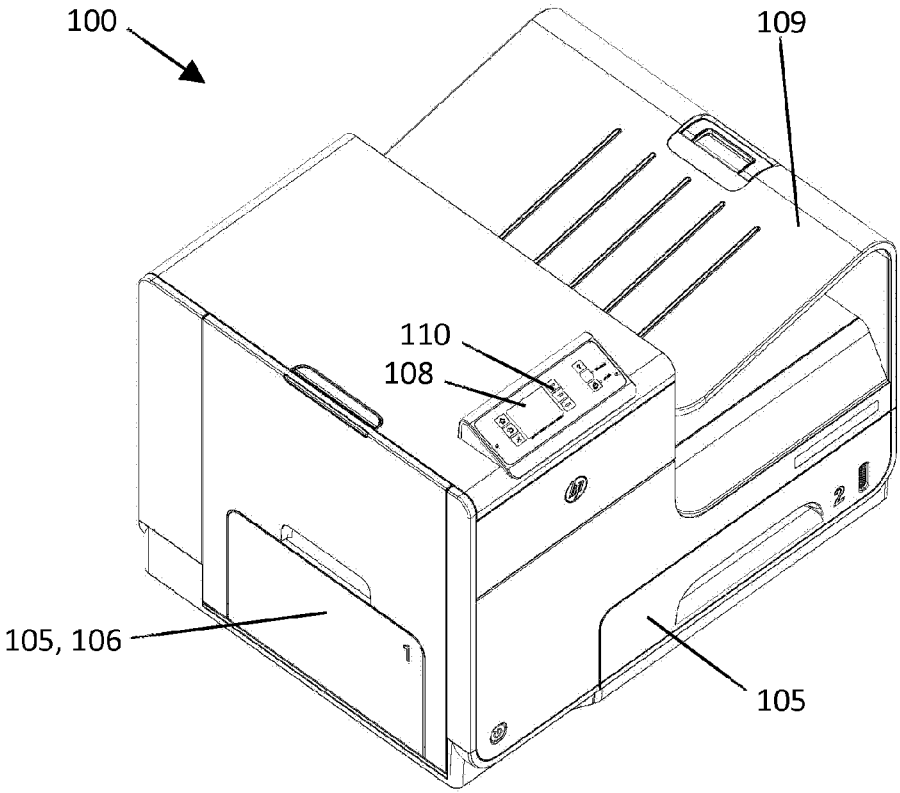
FIG. 1 shows a printing system in accordance with at least one example.

Certain terms are used throughout the following description and in the claims to refer to particular system components. Companies and people may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. In addition, if the connection is an electrical connection, whether analog or digital, the coupling may comprise wires or a mode of wireless electromagnetic transmission, for example, radio frequency, microwave, optical, or another mode. So too, the coupling may comprise a magnetic coupling or any other mode of transfer known in the art, or the coupling may comprise a combination of any of these modes. The recitation "based on" means "based at least in part on." Therefore, if X is based on Y, X may be based on Y and any number of other factors.

The drawing figures are not necessarily to scale. Certain features and components disclosed herein may be shown exaggerated in scale or in somewhat schematic form, and some details of conventional elements may not be shown in the interest of clarity and conciseness. In some of the figures, in order to improve clarity and conciseness of the figure, one or more components or aspects of a component may be omitted or may not have reference numerals identifying the features or components that are identified elsewhere. In addition, like or identical reference numerals may be used to identify equivalent or similar elements.

Any reference to a direction with respect to an object, for example upward, leftward, and clock-wise, is made for purpose of clarification and pertains to the orientation as shown. If the object were viewed from another orientation, it may be appropriate to described direction using an alternate term.

In addition, as used herein, including the claims, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis.

Multiple uses of phrases such as "in various implementations" or "In various examples" are to be considered as broadly as is reasonable. Thus the statements, "Various implementations include a feature X. Various implementations include a feature Y" should be interpreted to say that some implementations or embodiments may have feature X, may have feature Y, may have feature X and feature Y, or may have neither feature X nor feature Y.

DETAILED DESCRIPTION

As described herein, an object detection system includes a sensor coupled to a multi-directional mechanical flag. The flag disturbs or engages the sensor when an object's presence causes the flag to move. The geometry of the flag allows it to move in three modes: rotation, translation, and combined rotation and translation. These multiple modes allow the flag to sense the presence of an object that may approach from a variety of directions. The object detection system is applicable for detecting a single sheet of print media or for detecting a stack of print media in a printer system. The multi-directional mechanical flag and the object detection system each have wider applicability, such as sensing product presence in a paper mill rolling operation and detecting a plate of raw material adjacent a milling machine, for example.

In various examples, the sensor is an optical photo-interrupter because it emits and receives an optical beam along a transmission path. When the mechanical flag moves to a rotated, a translated, or a rotated and translated position, the flag obstructs or blocks the transmission path of the optical beam, and this obstruction is detected by the photo-interrupter. In other implementations, the flag obstructs or blocks the transmission path until an object's presence causes the flag to move to a rotated, a translated, or a rotated and translated position, clearing the transmission path of the optical beam. In various examples, the sensor may include a capacitive proximity switch, magnetic proximity switch, a mechanical switch, or any suitable sensor known in the art. In some implementations, the sensor does not include an optical emitter-detector pair.

Figure 2:
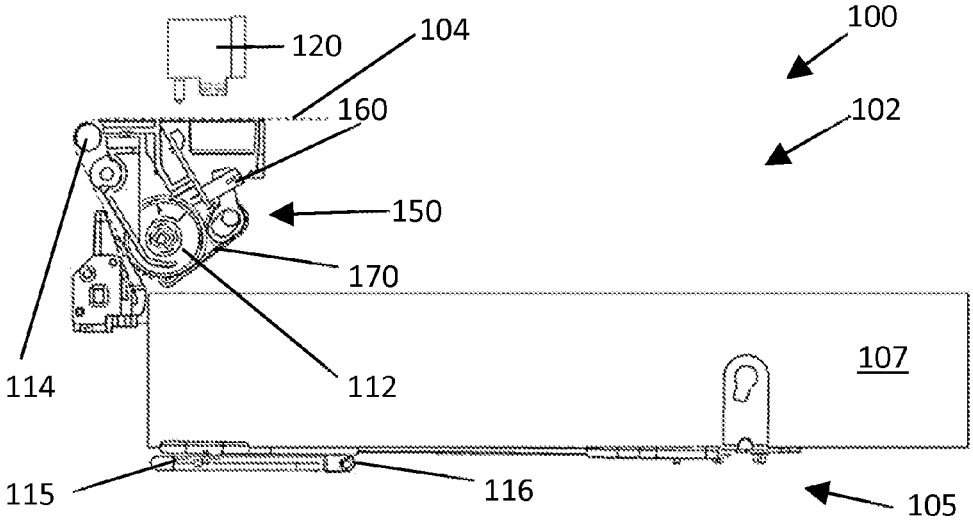
FIG. 2 shows side view of a print media pick system of the printing system of FIG. 1 in accordance with at least one example.

Referring now to FIGS. 1 and 2, a printer system 100 includes a handling system 102 for print media, at least one ink transfer mechanism 120 to transfer ink, another type of fluid, or powdered toner onto a sheet or a piece of the print media, and an object detection system 150 to indicate the presence of print media. The object detection system 150 may indicate, for example, the presence of one sheet of print media or the presence of multiple sheets of print media. The handling system 102 includes at least one tray 105 in which multiple sheets of print media can be placed. Handling system 102 moves print media through a print media path extending from the tray 105, past ink transfer mechanism 120 and into an output tray 109. One example is print media path 104 in FIG. 2. The example of FIG. 1 shows two trays 105 for print media. One of these trays is an externally loading tray 106 having a door that rotates downward. In at least one embodiment, handling system 102 is capable of bi-directional movement of print media in at least some portion of a print media path. In at least one embodiment, printer 100 is capable of duplex printing, i.e., printing on two sides of the same sheet of print media.

The printer system 100 also includes a user display 108 to provide visual feedback and information to the user of the printer and includes one or more user input controls 110 (e.g., buttons) that can be activated by the user to cause various actions to be performed by the printer.

Figure 3:
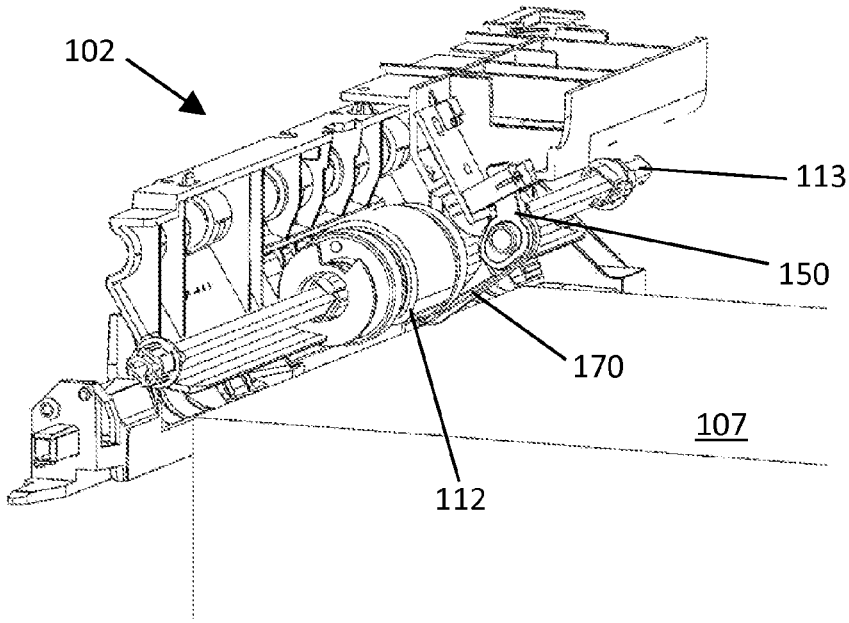
FIG. 3 shows a close-up perspective view of the media pick system of FIG. 2 in accordance with at least one example.

Referring to FIGS. 2 and 3, the printer system 100 includes one or more "pick wheels" 112, which may also be called tires. One pick wheel 112 on an axle 113 is shown adjacent one of the trays 105. A pick wheel 112 may contact print media in the tray 105 and rotate, grasping and pulling one sheet of print media from the tray along the print media path 104 for printing. As best seen in FIG. 3, the axial length of pick wheel 112 is less than the width of the print media, and object detection system 150 is axially displaced from wheel 112. A multi-directional mechanical flag 170 in the lower portion of system 150 is positioned above media tray 105 and above the leading edge of print media 107. During operation, the "picking" of the print media is assisted in this embodiment by a media lifting plate 115 that rotates around a pivot 116 under the influence of an actuator (not shown). The lifting plate 115 raises print media 107 to contact the adjacent pick wheel 112 and to contact the mechanical flag 170.

One or more gear trains operated by one or more electric motors drives the pick wheel 112 and other wheels 114 that move print media through the printer. A gear train may implement "tail-gating" in which the next sheet of print media is picked immediately after the preceding sheet has been picked with only a short gap between the sheets. A gear train may cause the pick wheel 112 to take a single sheet at a time, i.e., without tail-gating. Tail-gating may be used to print a multi-sheet document while single sheet picking may be used to print a single sheet document or may be used to print the last page of a multi-sheet document to avoid picking an extra blank sheet following the completion of the document.

Figure 4:
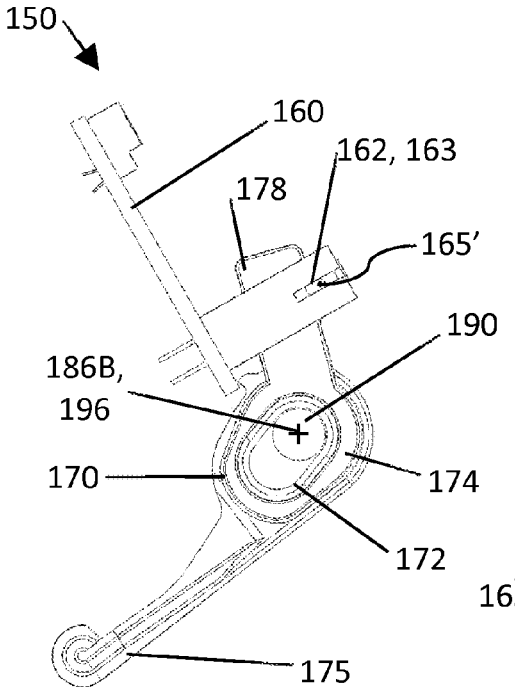
FIG. 4 shows a side view of an object detection system of the media pick system of FIG. 2 in accordance with at least one example.

Referring now to FIG. 4, the object detection system 150 includes a sensor 160 and the multi-directional mechanical flag 170, which has an elongate aperture 172. System 150 also includes a mounting pin 190 extending through the elongate aperture 172 and having a central axis 196. The mechanical flag 170 is rotatably and translatably mounted adjacent the sensor by the elongate aperture and the pin 190. As applied to printer system 100, the detection system 150 is a type of print media sensor. Detection system 150 indicates when the leading edge of a sheet of print media reaches the location of the flag 170 or when the trailing edge of a sheet of print media departs from the location of the flag 170. Thus detection system 150 may be used to sense the presence of a sheet of print media or to measure the length of a sheet of print media.

Figure 5:
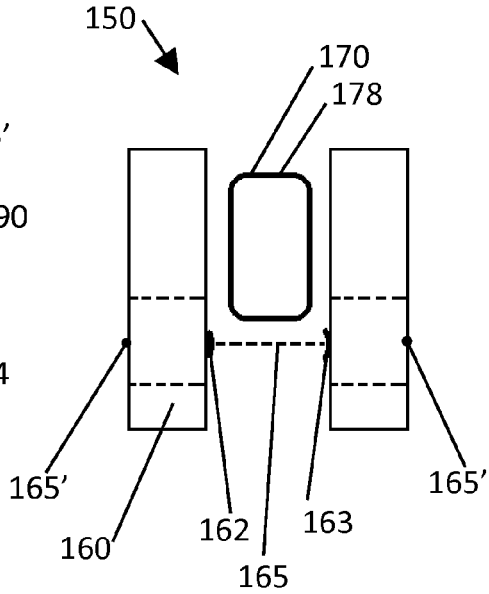
FIG. 5 shows a schematic upper view of the object detection system of FIG. 4.

Referring to the side view of FIG. 4 and the upper schematic view of FIG. 5, sensor 160 includes an optical emitter (e.g., a light emitting diode) 162 and an optical detector (e.g., a photo detector) 163. Emitter 162 and detector 163 are separated by a distance with an optical transmission path 165 extending the distance between the emitter-detector pair. In the side view of FIG. 4, a projected dot 165' ("165 prime") represents the location of transmission path 165.

Figure 6:
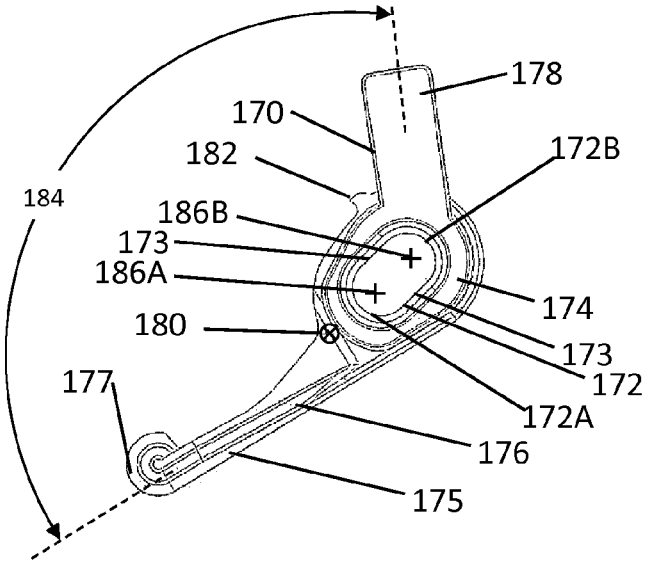
FIG. 6 shows a side view of the multi-directional mechanical flag of the object detection system of FIG. 4 in accordance with at least one example.

Referring to FIG. 6, multi-directional mechanical flag 170 further includes a body portion 174 in which the elongate aperture 172 is disposed, a head portion 175 extending from the body portion 174, a tail portion 178 also extending from the body portion, and a center of gravity 180. Head portion 175 may also be called "head" 175, and tail portion 178 may also be called "tail" 178. Head 175 includes a neck 176 and a distal end 177. At least in this example, end 177 is curved. In the example of FIG. 6, mechanical flag 170 further includes a mechanical stop 182 protruding from body portion 174 to act as a rotation limiting element by sometimes contacting a portion of sensor 160 or another stationary object.

In FIG. 6, the center of gravity 180 of mechanical flag is proximal the intersection of body portion 174 and head 175, specifically the neck 176 of head 175. As is evident from the perspective view of FIG. 3 and the feature lines in FIG. 4, in at least one example, flag 170 is not a simple extrusion of a flat two-dimensional profile. The three-dimensional shape of flag 170 influences at least the location of the center of gravity 180.

FIGS. 2, 3, and 4 illustrate the resting position of flag 170, with head 175 located below the tail 178, as biased by center of gravity 180. Head 175 hangs down toward tray 105 without contacting print media 107 while media lifting plate 115 is horizontal and inactive so that no media is engaged by the pick wheel 112. In various other configurations of printer system 100, head 175 of flag 170 rests on a surface, such as the surface of print media 107 while no print media is being actively lifted in tray 105 or fed through the printer system.

Continuing to reference the example of FIG. 6, elongate aperture 172 in body portion 174 includes a rounded first end 172A and a rounded second end 172B with parallel sides 173 extending between ends 172A, 172B. An axis 186A is positioned at the center of curvature of first end 172A, and an axis 186B is positioned at the center of curvature of second end 172B. The head 175 of the mechanical flag 170, which extends from body portion 174, is proximal the aperture's first end 172A. The tail 178 of the mechanical flag 170, which also extends from body portion 174, is proximal the aperture's second end 172B. Head 175 and tail 178 are positioned about the perimeter of the body portion 174, being oriented relative to each other by an angle 184 (a reference numeral, not an angular measurement). Angle 184 may have any value that allows mechanical arm 170 to function as described herein. In FIG. 6, angle 184 is greater than ninety degrees. In various other embodiments, head 175 and tail 178 may be disposed adjacent the same end 172A, 172B of elongate aperture 172. In these other embodiments, head 175 and tail 178 may be oriented relative to each other by an angle 184 less than ninety degrees. In various examples, head 175 and tail 178 are axially off-set from one another with respect to an axis 186A, 186B.

As shown in FIGS. 4 and 5, while in the resting position, tail 178 is located generally between emitter 162 and detector 163 but does not intersect transmission path 165.

Figure 7:
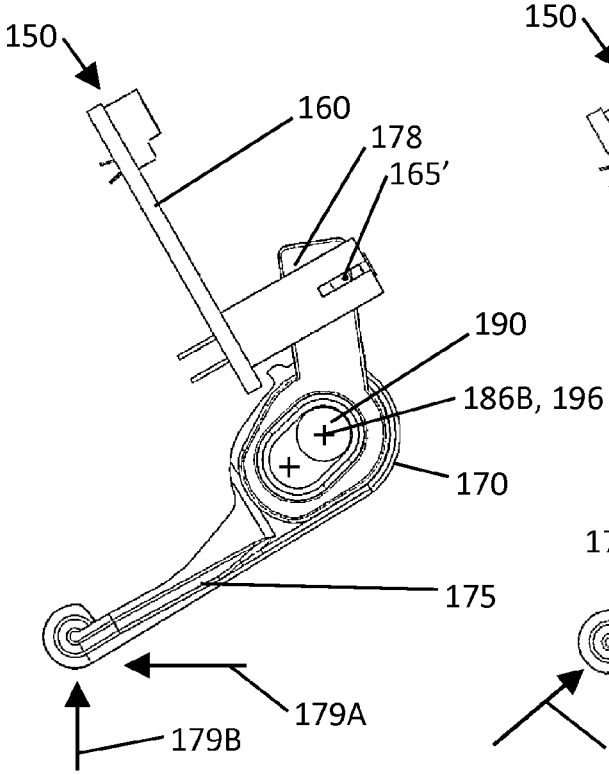
FIG. 7 shows an arrangement of the object detection system of FIG. 4 having a mechanical flag in a rotated arrangement in accordance with at least one example.

Referring now to FIG. 7, mechanical flag 170 may experience a clock-wise pivot or rotation 171 about pin 190 when head 175 is pushed by a force or an object in a generally rightward direction 179A or when pushed by an object in a generally upward direction 179B. The flag 170 and its head 175 may rotate when contacted by the front edge of a sheet of print media that is lifted upward by plate 115 of FIG. 2. As a consequence, tail 178 changes position and blocks the transmission path 165 of sensor 160, which is evident in FIG. 7 because tail 178 is aligned with projected dot 165'.

Figure 8:
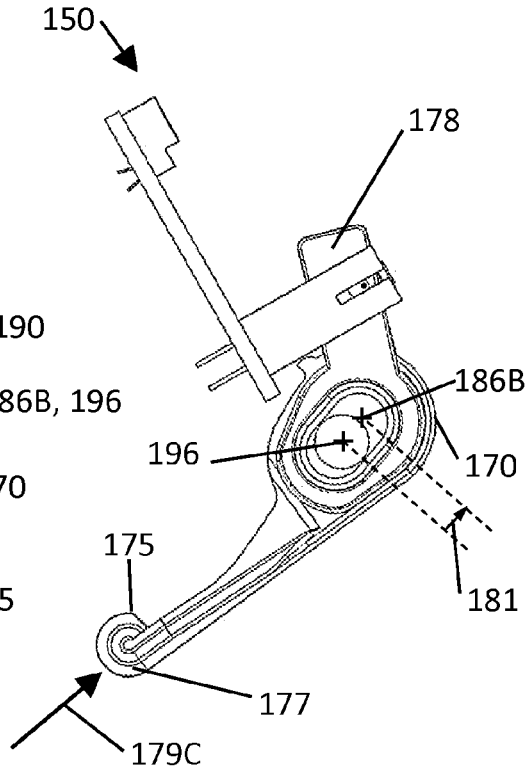
FIG. 8 shows the object detection system of FIG. 4 with the mechanical flag in a translated arrangement in accordance with at least one example.

FIG. 8 illustrates that a force or an object pushing from the lower-left in a direction 179C may cause flag 170 to translate, i.e., to move without rotation, to a new position that also blocks transmission path 165. In FIG. 8, flag 170 has moved by a distance 181 (a reference numeral, not a measurement value) causing axis 186B of elongate aperture 172 to move from axis 196 of pin 190. As a consequence, tail 178 changes position and blocks the transmission path 165 of sensor 160. In an example shown in FIG. 9, the translational movement illustrated in FIG. 8 is accomplished by the lifting plate 115 raising one or a relatively small number of sheets of print media 107 to contact the pick wheel 112 and the mechanical flag 170. Because tray 105 is nearly empty, lifting plate 115 lifts the front edge of print media 107 to a higher angle than would occur when lifting the greater quantity of media 107 shown in FIG. 2. Consequently, the front edge of a sheet of print media 107 contacts end 177 of head 175 from the lower left, i.e., generally the direction 179C of FIG. 8.

In general, an object or force approaching and acting from a direction 179A, 179B, 179C, or from one of various other directions may rotate, translate, or simultaneously rotate and translate the mechanical flag 170 and tail 178 with respect to sensor 160. Thus, the tail 178 of the mechanical flag 170 is configured for movement between a first position, as exemplified the resting position in FIG. 4, and a second position, as exemplified separately by FIG. 7 and by FIG. 8. Depending on the circumstances, the second position of the tail is a rotated position, a translated position, or a rotated and translated position with respect to the first position. As explained, tail 178 does not block the transmission path 165 when in the first position, and tail 178 does block the transmission path 165 when in any of the multiple second positions. In some embodiments of detection system 150, the first position of tail 178 refers to a precise arrangement between the relative locations of tail 178 and sensor 160 (particularly transmission path 165). In various other embodiments, the first position of tail 178 refers to multiple positions or a range of angular positions of tail 178 relative to transmission path 165, any of which leaves transmission path 165 not blocked. The distance that tail 178 rotates or translates from the first position to the second position differs in various instances and in various embodiments.

During operation of detection system 150, emitter 162 emits light that travels through the transmission path 165 to reach the detector 163 when transmission path 165 is not blocked. Sensor 160 produces a changeable electrical signal based on whether or not light from emitter 162 is blocked from reaching detector 163 by interference of tail 178 of flag 170. Interference of tail 178 was explained previously when discussing the first and the second positions of tail 178. In this manner, in at least in some instances, the signal from sensor 160 indicates whether or not print media is contacting head 175 on the flag. The signal may be used by printer system 100 to control the activation of the pick wheel 112 or ink transfer mechanism 120, for example.

Figure 10:
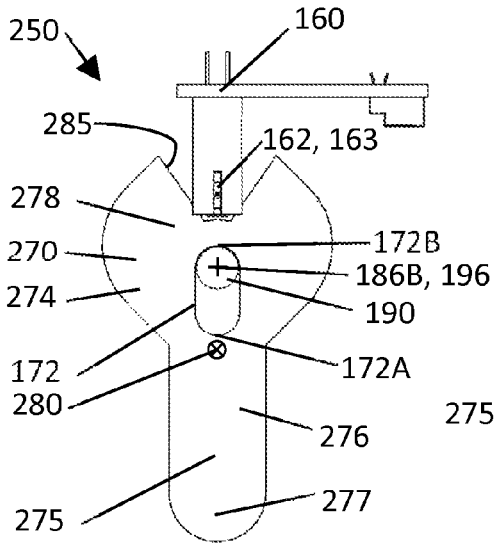
FIG. 10 shows a side view of an alternate embodiment of an object detection system having a multi-directional mechanical flag in accordance with at least one example.

FIG. 10 shows another example of an object detection system having a multi-directional mechanical flag. In particular, an object detection system 250 includes a sensor 160, a multi-directional mechanical flag 270 with an elongate aperture 172, and a mounting pin 190 extending through the elongate aperture 172. The sensor 160, the elongate aperture 172, and the mounting pin 190 are similar to the identically numbered features of detection system 150. For example, sensor 160 of detection system 250 includes an emitter 162 and a detector 163 separated by a distance having a transmission path 165 (FIG. 5) extending between the emitter-detector pair. Detection system 250 provides functionality similar or equivalent to the functionality of detection system 150 and may provide additional functionality, as will be described. In at least one embodiment, detection system 250 is compatible with printer system 100.

Multi-directional mechanical flag 270 includes a body portion 274 in which the elongate aperture 172 is disposed, a head portion 275 extending from the body portion 274 proximal rounded first end 172A of aperture 172, and a tail portion 278 also extending from the body portion but proximal rounded second end 172B. Head portion 275 may also be called head 275, and tail portion 278 may also be called tail portion 278. Head portion 275 includes a neck 276 and a distal end 277. At least in this example, end 277 is rounded.

Figure 11:
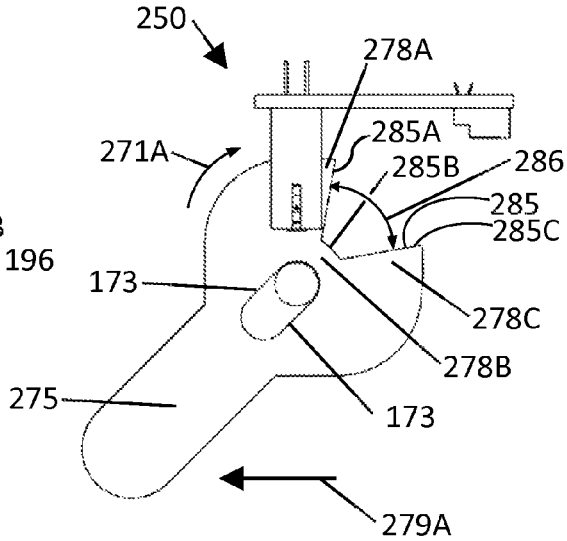
FIG. 11 shows the object detection system of FIG. 10 having the mechanical flag rotated clock-wise in accordance with at least one example.

Referring to FIGS. 10 and 11, tail portion 278 includes multiple tail regions defining a recess 285. In the example shown, tail portion 278 includes three tail regions 278A, 278B, 278C, and recess 285 is generally trapezoidal. Recess 285 is positioned 180 degrees opposite the head portion 275 and includes three edges 285A, 285B, 285C and extends through the perimeter of tail portion 278. The two edges 285A, 285C extend in a generally radial direction with respect to axis 186B of elongate aperture 172 and may also be called "sides" 285A, 285C. The edge 285B joins sides 285A, 285C, following a generally circumferential path adjacent yet radially beyond the rounded second end 172B of the aperture 172. Edge 285B may also be called "base" 285B. Sides 285A are separated by an angle 286 (a reference numeral, not an angular measurement), which in this example is less than 90 degrees. In other examples, the value of angle 286 is greater than 90 degrees. Additional modifications to recess 285 and its edges 285A, 285B, 285C are possible. For example, in various examples, recess 285 is closed, not extending through the perimeter of tail portion 278. In various examples, tail portion 278 and recess 285 are at an angular location less than 180 degrees from head portion 275 with the angular location of sensor 160 and transmission path 165 with respect to mechanical flag 270 correspondingly adjusted. Some modifications may alter the rotational and translational sensitivity of detection system 250.

The center of gravity 280 of mechanical flag 270 is chosen so that the end distal end 277 of head portion 275 is biased downward by gravity, as is evident when mechanical flag 270 is in the resting position shown in FIG. 10. In other examples, the center of gravity may be located so as to achieve another orientation of head portion 275 while in the resting position.

FIG. 10 shows a resting position of tail portion 278 on flag 270 when installed in the detection system 250. The resting position corresponds to times when no force or object, e.g., no print media, displaces head portion 275. For reference, the transmission path 165 for detection system 250 is similar to the path 165 illustrated for detection system 150 in FIG. 5. While in the resting position, tail portion 278 is located generally between emitter 162 and detector 163 but does not intersect transmission path 165. Therefore, the resting position corresponds to a "first position" of tail portion 278 and flag 270.

As shown in FIG. 11, mechanical flag 270 may experience a clock-wise pivot or rotation 271A about pin 190 when head 275 is pushed by a force or an object in a generally leftward direction 279A. The rotation 271A may causes tail 278 to move from the resting position. In the example shown, tail region 278A has moved sufficiently to block the transmission path 165 of sensor 160, which is indicated by projected dot 165'. Thus tail 278 may move from a first position (FIG. 10) to a second position (FIG. 11). Movement in the opposite direction is also possible.

Figure 12:
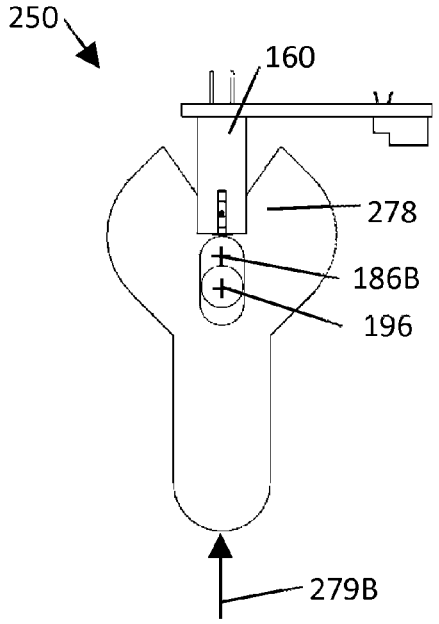
FIG. 12 shows the object detection system of FIG. 10 having the mechanical flag translated in accordance with at least one example.

FIG. 12 demonstrates that a force or an object pushing in a generally upward direction 179B may cause flag 270 to translate, i.e., to move without rotation. In FIG. 12, elongate aperture 172 of flag 270 is displaced upward relative to pin 190. As a consequence, tail region 278B blocks the transmission path 165 of sensor 160.

Figure 13:
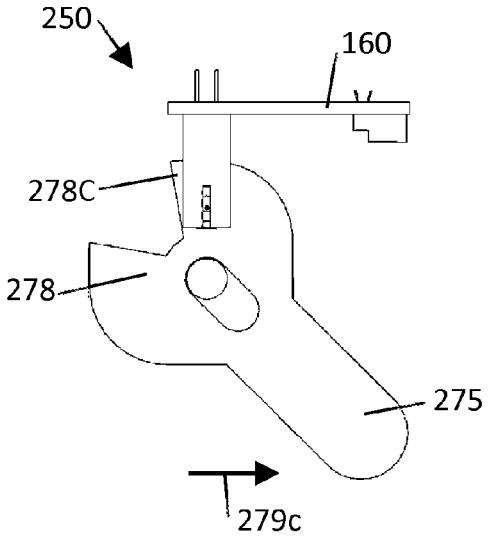
FIG. 13 shows the object detection system of FIG. 10 having the mechanical flag rotated counter clock-wise in accordance with at least one example.

FIG. 13 illustrates that mechanical flag 270 may experience a counter clock-wise pivot or rotation 271B about pin 190 when head 275 is pushed by a force or an object in a generally rightward direction 279A. As a consequence, tail region 278C blocks the transmission path 165 of sensor 160.

In general, an object or force approaching and acting from directions 279A, 279B, 279C, or from various other directions may rotate, translate, or simultaneously rotate and translate the mechanical flag 270 and tail 278 with respect to sensor 160 and its transmission path 165. The flag 270 and its tail 278 may move when contacted, for example, by the edge of a sheet of print media that moves rightward, leftward, or is lifted upward by a media handing system when the detector 270 is installed in a printer system, such as printer system 100.

Figure 9:
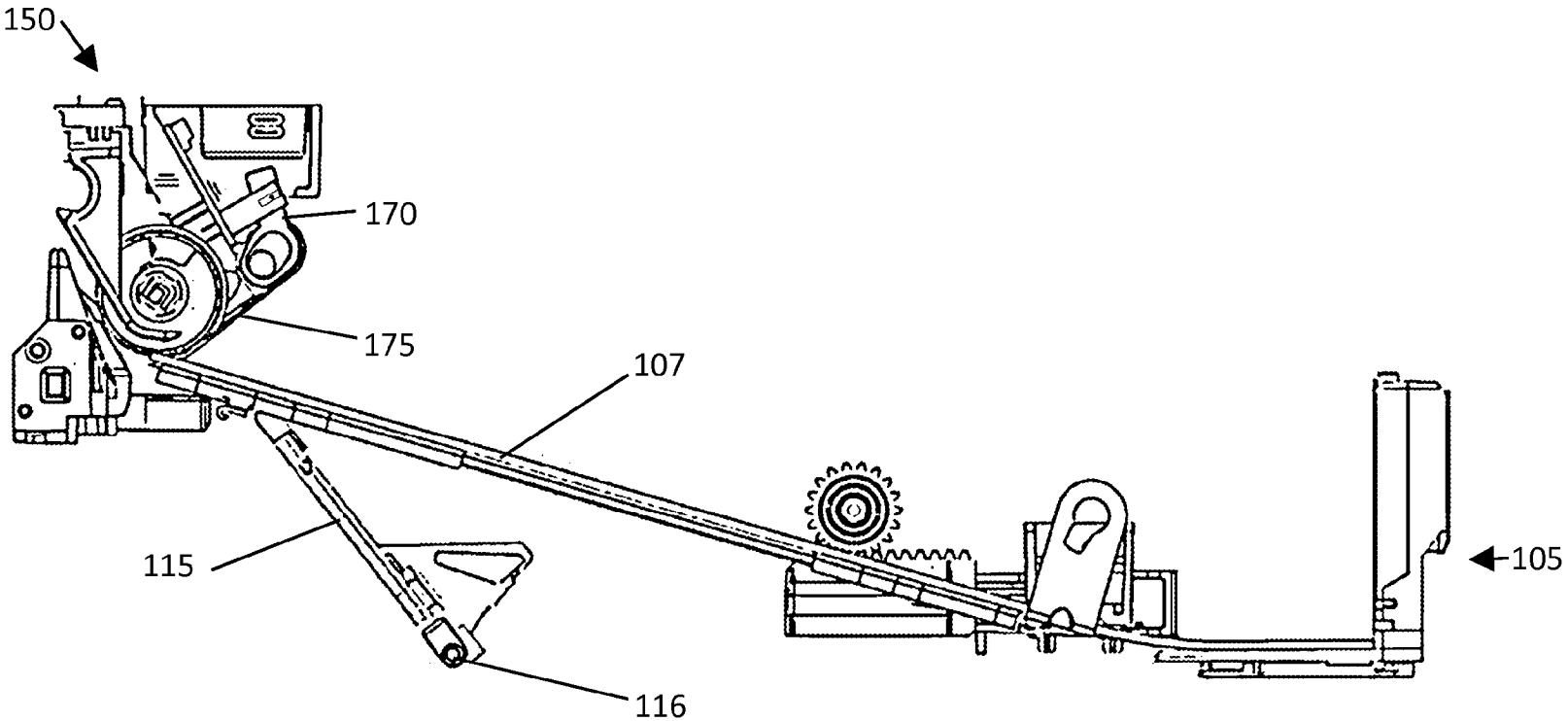
FIG. 9 shows side view of the print media pick system of FIG. 2 wherein the print media supply is low in accordance with at least one example.

Thus, the tail 278 of the mechanical flag 270 is configured for movement between a first position, as exemplified in FIG. 9, and a second position, as exemplified separately by FIGS. 11, 12, and 13. Depending on the circumstances, the second position of the tail is a rotated position, a translated position, or a rotated and translated position with respect to the first position. In various instances, the tail 278 of the mechanical flag 270 may be rotated in a clock-wise direction or in a counter clock-wise direction to move from a first position to a second position due to the multiple tail regions.

Tail 278 does not block the transmission path 165 when in any first position, and tail 278 does block the transmission path 165 when in any second position. In some embodiments of detection system 250, the first position of tail 278 refers to a precise arrangement between the relative locations of tail 278 and the mating sensor 160 (particularly transmission path 165). In various other embodiments, the first position of tail 278 refers to multiple positions of tail 278 relative to transmission path 165, any of which leaves transmission path 165 not blocked. The distance that tail 278 rotates or translates from the first position to the second position differs in various instances and in various embodiments.

Figure 14:
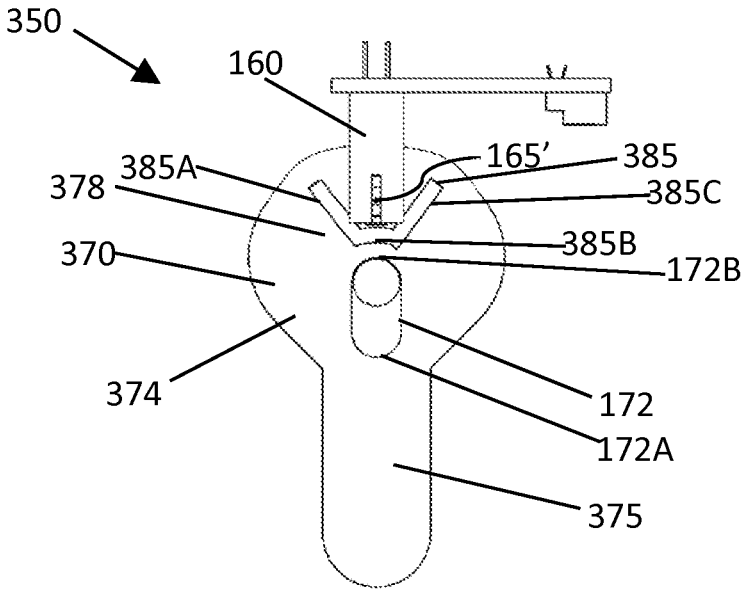
FIG. 14 shows a side view of another embodiment of an object detection system having a multi-directional mechanical flag in accordance with at least one example.

FIG. 14 shows another example of an object detection system having a multi-directional mechanical flag. In particular, an object detection system 350 includes a sensor 160, a multi-directional mechanical flag 370 with an elongate aperture 172, and a mounting pin 190 extending through the elongate aperture 172. The sensor 160, the elongate aperture 172, and the mounting pin 190 are similar to the identically numbered features of detection system 250. For example, sensor 160 of detection system 350 includes an emitter 162 and a detector 163 separated by a distance having a transmission path 165 (FIG. 5) extending between the emitter-detector pair. Detection system 350 provides functionality similar or equivalent to the functionality of detection system 250. In at least one embodiment, detection system 350 is compatible with printer system 100.

Multi-directional mechanical flag 370 includes a body portion 374 in which the elongate aperture 172 is disposed, a head portion 375 extending from the body portion 374 proximal rounded first end 172A of aperture 172, and a tail portion 378 also extending from the body portion but proximal rounded second end 172B.

Tail portion 378 includes a closed recess or slot 385. In this example, slot 385 has three distinct sections 385A, 385B, 385C. The two slot sections 385A, 385C extend in a generally radial direction with respect to axis 186A of elongate aperture 172. Slot 385 is positioned 180 degrees opposite the head portion 375. Slot sections 385B joins slot sections 385A, 385C, following a generally circumferential path adjacent yet radially beyond the rounded second end 172B of the aperture 172. Slot sections 385A, 385C are separated by an angle that is in this example less than 90 degrees. In other examples, the value of angle 386 is greater than 90 degrees. In other examples, tail portion 278 and slot 385 are at an angular location less than 180 degrees from head portion 375 with the angular location of sensor 160 with respect to mechanical flag 370 correspondingly adjusted. In various examples the slot 385 is formed in another suitable shape that provides the functionality described herein. For example, in some embodiments, slot 385 may include a smooth, outward facing arc. Some modifications may alter the rotational and translational sensitivity of detection system 350.

FIG. 14 shows a resting position for mechanical flag 370. Unlike tail 278 of detection system 250, tail portion 378 blocks transmission path 165 of sensor 160 while mechanical flag 370 is in its resting position. To maintain the same naming convention as used for detectors 150, 250, any position of tail 378 that blocks transmission path 165 may be called a "second position" of flag 370 and tail portion 378. Therefore, the resting position represented in FIG. 14, is a second position. It is apparent that various rotations or translations of flag 370 may leave transmission path 16 blocked by tail 378, and so flag 370 has more than one second position.

In various instances involving mechanical flag 370, an object or force contacting and acting upon head 375 from any of various directions may rotate, translate, or simultaneously rotate and translate the flag 370 and tail 378 with respect to sensor 160 and transmission path 165 and cause a section of slot 385 to align with transmission path 165 of sensor 160. In these instances, tail 378 ceases to block transmission path 165, and therefore tail 378 is considered to be in a "first position." Multiple arrangements of tail 378 leave transmission path 165 not blocked. When the object or force is removed, flag 370 and tail 378 return from the first position to the resting position, which is called the second position for this embodiment.

Thus, the tail 378 of the mechanical flag 370 is configured for movement between a first position and a second position, the second position being exemplified in FIG. 14. Depending on the circumstances, the first position of the tail is a rotated position, a translated position, or a rotated and translated position with respect to the second position. Likewise, the second position of the tail is a rotated position, a translated position, or a rotated and translated position with respect to the first position. To reiterate, tail 378 of detection system 350 does not block the transmission path 165 when disposed in any of the possible first positions, and tail 378 does block the transmission path 165 when disposed in any of the possible second positions.

For any of the object detection systems 150, 250, 350, the sensor 160 includes or couples to logic that interprets the sensor signal and accordingly reacts to the presence of print media or another object that contacts the respective mechanical flag 170, 270, 370. The logic may be implemented in circuitry or machine readable instructions. The logic accounts for the configuration of the particular object detection system. For example, object detection systems 150, 250 are configured so that the resting position of the respective mechanical flag 170, 270 is displaced from the transmission path 165. The flag 170, 270 moves to block the transmission path when contacted by an object. In contrast, in object detection system 350, the resting position of the mechanical flag 370 blocks the transmission path 165, and the flag opens the transmission path 165 when contacted by an object, allowing optical detector 163 to receive the optical beam from emitter 162.

Multiple variations and modifications are possible for the multi-directional mechanical flags, for the object detection systems, and for the printer system disclosed herein. Some such variations, modifications, and additional details are described here.

The object detection systems and the multi-directional mechanical flags described herein are applicable in a variety of printer systems having a variety of ink transfer mechanisms, including for example, jet ink printers with moving print heads, printers with page-wide array print mechanisms, laser printers, in which the ink may be a toner. The object detection systems and the multi-directional mechanical flags are applicable in handling systems for cut sheets of print media, handling systems for rolled sheets of print media, and automatic document feeders such as may be used for scanners or photocopiers. The printer systems may include object detection systems having multi-directional mechanical flags at locations in the print media path other than or in addition to the location shown in FIGS. 2 and 3.

As previously described by various examples, the shapes of the various features of a multi-directional mechanical flag may be varied and still provide the functionality described herein. In various examples, the resting position of a multi-directional mechanical flag is oriented in any advantageous direction, including vertical with the tail portion above the head portion (as described previously), vertical with the head portion of the flag above the tail portion, and, horizontal, for example. The arrangement of the pin, the sensor, and any other components of a corresponding object detection system is compensated accordingly when appropriate. In various embodiments, the center of gravity of a multi-directional mechanical flag is selected to modify the resting position. Methods for changing the center of gravity include, for example, changing the length of head or tail, altering other aspects of the three-dimensional shape of flag, and coupling a mass of material on or within the flag.

In various examples, the resting position of a multi-directional mechanical flag is biased by a spring. The spring is attached between the flag and the sensor or between the flag and another convenient location in order to return flag to a resting position when any contact force is removed. When used, the spring assists the mechanical flag to operate when installed in a variety of orientations, in addition to operating in the vertical orientation shown in FIGS. 3, 4, and 10.

The above discussion is meant to be illustrative of the principles and various embodiments of the present invention. Numerous other variations and modifications will become apparent to those skilled in the art once the above disclosure is fully appreciated. It is intended that the following claims be interpreted to embrace all such variations and modifications.

What is claimed is:

1. A mechanical flag for an object detection device, the mechanical flag comprising:
- a body portion;
- a head portion extending from the body portion;
- a tail portion extending from the body portion; and
- an elongate aperture disposed in the body portion and about which the mechanical flag is rotatable and translatable.

2. The mechanical flag of claim 1 wherein the elongate aperture comprises a first end and a second end;
- wherein the head portion extends from the body portion proximal the aperture first end; and
- wherein the tail portion extends from the body portion proximal the aperture second end.

3. The mechanical flag of claim 2 wherein the head portion and tail portion are spaced about the perimeter of the body portion by an angle greater than ninety degrees.

4. The mechanical flag of claim 1 wherein the elongate aperture comprises a rounded first end, a rounded second end, and two parallel sides extending between the first end and the second end.

5. An object detection system comprising:
- a sensor; and
- a mechanical flag including:
  - a body portion;
  - a head portion extending from the body portion;
  - a tail portion extending from the body portion; and
  - an elongate aperture disposed in the body portion;
- wherein the mechanical flag is rotatably and translatably mounted adjacent the sensor by the elongate aperture.

6. The object detection system of claim 5 further comprising a mounting pin;
- wherein the mounting pin extends through the elongate aperture of the mechanical flag.

7. The object detection system of claim 5 wherein the elongate aperture comprises a first end and a second end;
- wherein the head portion of the mechanical flag extends from the body portion proximal the aperture first end; and
- wherein the tail portion of the mechanical flag extends from the body portion proximal the aperture second end.

8. The object detection system of claim 7 wherein the head portion and tail portion are spaced about the perimeter of the body portion; and
- wherein the angle between the head portion and tail portion is greater than ninety degrees.

9. The object detection system of claim 5 wherein the elongate aperture comprises a rounded first end, a rounded second end, and two parallel sides extending between the first end and the second end.

10. The object detection system of claim 5 wherein the tail portion of the mechanical flag is configured for movement between a first position and a second position; and
- wherein the second position of the tail portion is one of a translated position and a rotated and translated position with respect to the first position.

11. The object detection system of claim 10 wherein the sensor comprises:
- an optical emitter and an optical detector; and wherein a signal from the emitter travels through a transmission path to reach the detector; and wherein the tail portion in the first position does not block the transmission path and wherein the tail portion in the second position blocks the transmission path.

12. The object detection system of claim 11 wherein the tail portion comprises more than one tail region to allow rotation from the first position to the second position selectively in a clock-wise direction or in a counter clock-wise direction.

13. A printer system comprising:

a handling system for print media;

an ink transfer mechanism to transfer ink onto a sheet of the print media;

a sensor;

a mechanical flag comprising:

a body portion;

a head portion extending from the body portion;

a tail portion extending from the body portion; and an elongate aperture disposed in the body portion; and a mounting pin extending through the elongate aperture of the mechanical flag.

14. The printer system of claim 13 wherein the tail portion of the mechanical flag is configured for movement between a first resting position and a second position when the sheet of print media contacts and moves the head portion; and wherein the second position of the tail portion is one of a translated position and a rotated and translated position with respect to the first position.

15. The printer system of claim 14 wherein the a sensor comprises:

an emitter to emit a signal; and a detector to receive the signal through a transmission path.

16. The printer system of claim 15 wherein the tail portion in the first position does not block the transmission path and wherein the tail portion in second position blocks the transmission path.

17. The printer system of claim 16 wherein the tail portion comprises more than one tail region to allow movement from the first position to the second position selectively in a clock-wise direction or in a counter clock-wise direction.

18. The printer system of claim 13 wherein the sensor is an optical photo-interrupter.

* * * * *

UNITED STATES PATENT AND TRADEMARK OFFICE

CERTIFICATE OF CORRECTION

PATENT NO. : 8,752,829 B1
APPLICATION NO. : 13/743590
DATED : June 17, 2014
INVENTOR(S) : Devin S. Uehling It is certified that error appears in the above-identified patent and that said Letters Patent is hereby corrected as shown below:

In the Claims:

In column 12, line 8, in Claim 15, after "the" delete "a".

Signed and Sealed this
Twenty-first Day of October, 2014

Michelle K. Lee

Michelle K. Lee
*Deputy Director of the United States Patent and Trademark Office*